US006048181A

United States Patent [19]

Chang

[11] Patent Number: 6,048,181

[45] Date of Patent: Apr. 11, 2000

[54] FIXED VOLUME SPRAYER

[75] Inventor: In-Kook Chang, Mentor, Ohio

[73] Assignee: International Agriproducts Corporation, Hoffman Estates, Ill.

[21] Appl. No.: 09/065,079

[22] PCT Filed: Oct. 24, 1996

[86] PCT No.: PCT/US96/17077

§ 371 Date: Apr. 24, 1998

§ 102(e) Date: Apr. 24, 1998

[87] PCT Pub. No.: WO97/15808

PCT Pub. Date: May 1, 1997

[30] Foreign Application Priority Data

Oct. 24, 1995 [KR] Rep. of Korea ..... 95-36806
Jun. 14, 1996 [KR] Rep. of Korea ..... 96-21455

[51] Int. Cl.[7] ..... F04B 35/00

[52] U.S. Cl. ..... 417/401; 222/334; 222/389; 239/322; 239/525; 239/588

[58] Field of Search ..... 417/401; 222/334, 222/389; 239/322, 525, 588, 586, 283

[56] References Cited

U.S. PATENT DOCUMENTS

| | | | |
|---|---|---|---|
| 2,488,985 | 9/1949 | Peeps | 299/140 |
| 3,292,867 | 12/1966 | Hunter | 239/322 |
| 3,973,697 | 8/1976 | Crum et al. | 222/47 |
| 3,980,209 | 9/1976 | Collar | 222/323 |
| 4,047,541 | 9/1977 | Mercier et al. | 137/564.5 |
| 4,051,983 | 10/1977 | Anderson | 222/321 |
| 4,635,830 | 1/1987 | Wehr et al. | 222/334 |
| 4,923,094 | 5/1990 | O'Neill | 222/321 |
| 5,088,629 | 2/1992 | O'Neill | 222/321 |
| 5,335,858 | 8/1994 | Dunning et al. | 239/333 |
| 5,358,149 | 10/1994 | O'Neill | 222/321 |
| 5,522,547 | 6/1996 | Dobbs et al. | 239/333 |

OTHER PUBLICATIONS

Spraying System Co., "Spray Nozzles and Accessories" (1990).

Alemite Corporation "Lubricant Measuring Valve" (1994) pp. 1–2.

*Primary Examiner*—Teresa Walberg
*Assistant Examiner*—Vinod D Patel
*Attorney, Agent, or Firm*—Renner, Kenner, Greive, Bobak, Taylor & Weber

[57] ABSTRACT

This invention provides a power delivery device (10) for delivering a fixed volume of flowable material to a specific site, the power delivery device (10) comprising pumping means (14) for forcing a predetermined volume of the flowable material through at least one flow path (38,40) of the power delivery device (10) by means of line pressure exerted on the flowable material; and valve means (12), operatively connected to the pumping means (14), for selectively opening and closing the at least one flow path (38, 40) through which the flowable material moves such that the predetermined volume of flowable material can be sprayed out of the power sprayer (10) when the at least one flow path (40) is open and can be redirected to fill the power sprayer (10) when the at least one flow path (40) is closed.

18 Claims, 10 Drawing Sheets

FIXED VOLUME SPRAYER

TECHNICAL FIELD

This invention relates to a fixed volume power sprayer or similar power delivery device for delivering a fixed quantity of a flowable material to an item to be sprayed. More particularly, it relates to a fixed volume power sprayer or similar power delivery device which has a simple design, is convenient, and is easily controlled by a user to spray or otherwise deliver, intermittently, a fixed volume of flowable material. The sprayer is also designed such that the amount of flowable material to be sprayed per cycle of spraying can be adjusted.

BACKGROUND OF THE INVENTION

Generally, various agricultural machines, such as cultivators and tractors, are used to reduce labor costs and to improve production efficiency in the cultivation of crops. However, crops cultured by these machines often require nutrients and/or fertilizers for growth and reproduction. In addition, pesticides are oftentimes sprayed on these crops in order to protect them from pests. To apply these plant nutrients, fertilizers, growth regulators, pesticides, or other agricultural chemicals, liquid in form, on parts of plants or near the root zones of soil surfaces, growers typically use a manually-powered sprayer or applicator, which requires power to be generated by the hands or feet of the laborer, or a power sprayer or injector which utilizes pressure or driving force generated by a compressor, powered by an electric motor or an engine.

The aforementioned manual sprayer is typically used to spray such chemicals in a relatively small cultivating area, while the power sprayer is typically used over a large area where manual spraying may be difficult. Such a power sprayer is capable of continuously spraying agricultural chemicals to a cultivating area by spraying the chemicals through a nozzle, the chemicals being forced through the nozzle by pressure built up by the compressor. In other words, the user holds a nozzle handle that is connected to a hose that is, in turn, connected to a spray material tank and to a compressor, and moves along the crop rows, and sprays or injects chemicals continuously onto a place where the application is needed.

However, by using the power sprayers of this type, a user cannot control the precise amount or volume of liquid fertilizers, nutrients or other agricultural chemicals to be sprayed onto each plant during a continuous or intermittent application. Hence, spraying becomes irregular, resulting in lowered efficiency. Also, a continuous spray from a hand-held nozzle or a tractor-mounted applicator, invariably applies more chemicals than are needed for each plant due to the plant spacing in a row. The irregular and resultant overspraying may cause frequent phytotoxicity to non-target parts of crop plants, leave more harmful pesticide residues on soil surfaces and on crops that, in turn, could harm human beings as well as livestock, pollute the environment, and increase costs of crop production.

SUMMARY OF INVENTION

It is, therefore, an object of the present invention to provide a fixed volume power sprayer or delivery device which is capable of delivering in a very short period of time per cycle (e.g., in less than one second), a fixed volume of a flowable material.

It is another object of the present invention to provide a fixed volume power sprayer or delivery device which is capable of being preadjusted to determine the fixed amount or volume of flowable material to be delivered.

It is yet another object of the present invention to provide a fixed volume power sprayer or delivery device which has a simple design, and can be easily and freely controlled by a user with his fingertips, hand or foot for each application.

At least one or more of the foregoing objects, together with the advantages thereof over the known art relating to sprayers, which shall become apparent from the specification which follows, are accomplished by the invention as hereinafter described and claimed.

In general the present invention provides a power delivery device for delivering a fixed volume of flowable material to a specific site, the power delivery device comprising pumping means for forcing a predetermined volume of the flowable material through at least one flow path of the power delivery device by means of line pressure exerted on the flowable material; and valve means, operatively connected to the pumping means, for selectively opening and closing the at least one flow path through which the flowable material moves such that the predetermined volume of flowable material can be sprayed out of the power sprayer when the at least one flow path is open and can be redirected to fill the power sprayer when the at least one flow path is closed.

PREFERRED EMBODIMENT FOR CARRYING OUT THE INVENTION

A fixed volume power sprayer or similar delivery device embodying the concepts of the present invention generally comprises a pumping means that allows a fixed volume of flowable material to be sprayed or delivered through the nozzle by means of line pressure generated by pressurized air from a compressor or the like, and a valve means, connected to the pumping means, that turns each spraying on and off.

Such a fixed volume power sprayer works by having the flowable material initially fill the flow paths and chambers of the sprayer and then making a fixed volume of the flowable material move out through the nozzle by the action of the pumping means and the valve means. The driving force of the pumping means is the high pressure of air generated by the compressor which, in turn, pressures the flowable material within the hose line, flow paths, and chambers. Here, the valve means opens or closes flow paths that are connected to the pumping means so that a fixed volume of material can be delivered out of the nozzle.

Figure 1:
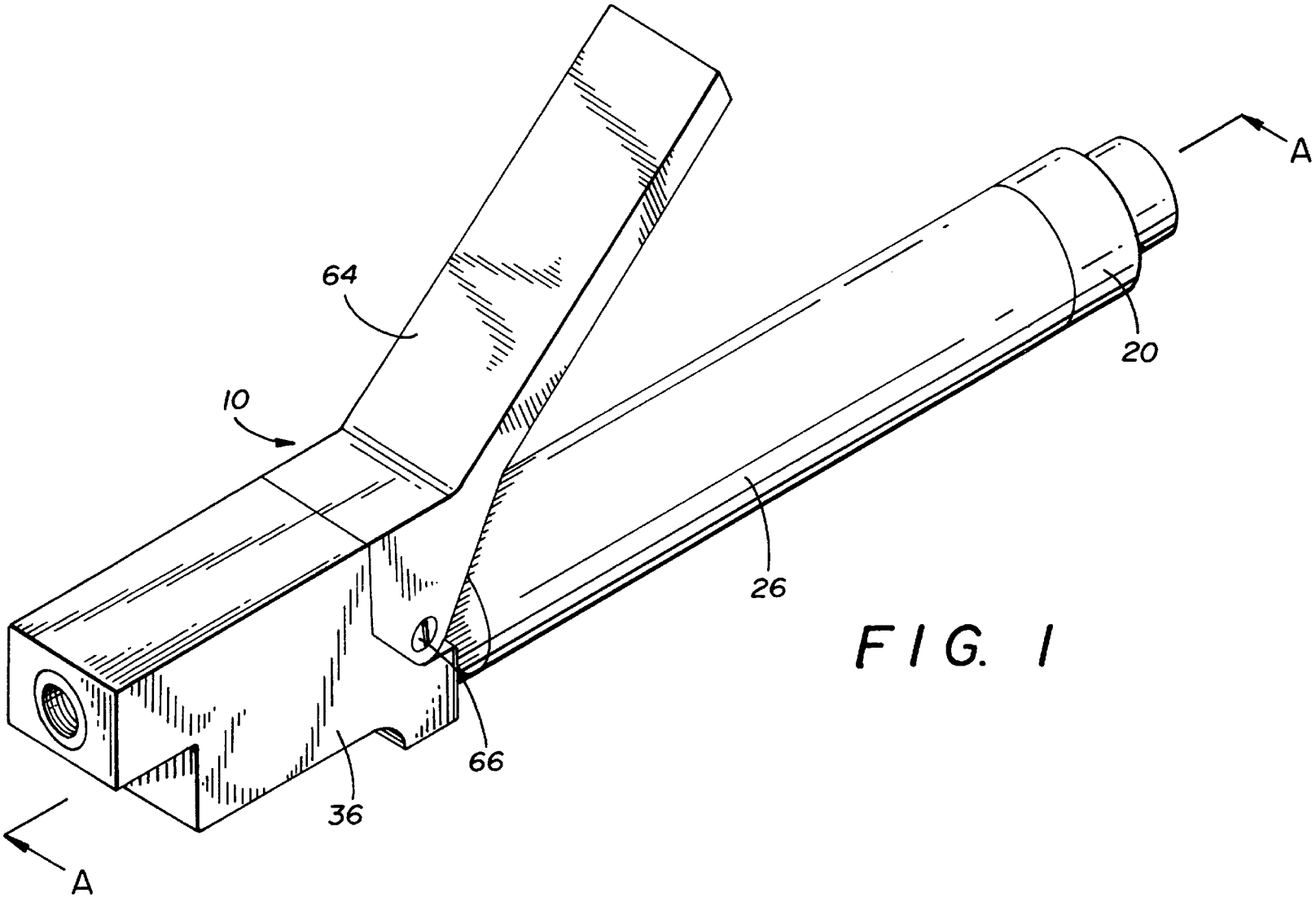
FIG. 1 is a perspective view of one embodiment of a fixed volume power sprayer in accordance with the present invention.

One example of a preferred embodiment of the fixed volume power sprayer of the present invention is generally designated by the numeral 10 in FIG. 1 and is described hereinbelow in detail with respect to FIGS. 1–4. A nozzle means (not shown) through which the flowable materials may be delivered to a specific site is typically connected to the fixed volume power sprayer 10 at one end thereof and a connecting means such as a hose line (not shown), operatively connected to a compressor (not shown), is typically connected to the other end of the sprayer 10. The nozzle means may be connected to a valve means, designated generally by the numeral 12 in FIG. 2, as generally known in the art, and the valve means 12 opens and closes to permit or prevent the movement of the flowable material to the nozzle means. A pumping means, designated generally by the numeral 14, allows a fixed volume of flowable material to be delivered to the valve means and, ultimately, the nozzle means, and is driven by the high pressure of the material which is compressed by the compressor.

With regard to the pumping means 14, it includes an inlet connector fitting 18 which may be connected to a connector stem (not shown) of the hose line or similar connecting means (not shown) at one end. A first main body 20 containing a first flow path 22 and a second flow path 24 is located on the opposite side of the connector fitting 18 from the hose line. A second main body 26 is sealingly connected to one end of the first main body 20 and defines a pumping chamber 28. A guide pipe 30 is mounted to one end of the first flow path 22 and resides inside of the second main body 26. A piston 32 is positioned around and sealingly contacts the outer surface of the guide pipe 30 through a central aperture in the piston 32 and resides in and sealingly contacts the inner surface of the second main body 26. An elastic or biasing component 34 such as a compression spring is supported at one end by the piston 32 and on the other end, by a third main body 36. The third main body 36 is attached to the end of the second main body 26 opposite the first main body 20, and contains a third flow path 38 that is connected to the guide pipe 30 and a fourth flow path 40 that is connected to the pumping chamber 28 of the second main body 26.

Specifically, the pumping chamber 28 is divided by the piston 32 into two compartments forming first and second pumping chambers 42 and 44, respectively. Thus, while the first flow path 22 is connected to the inner path of the guide pipe 30, the second flow path 24 is connected to the second pumping chamber 44. The first pumping chamber 42 is connected to the fourth flow path 40.

Figure 2:
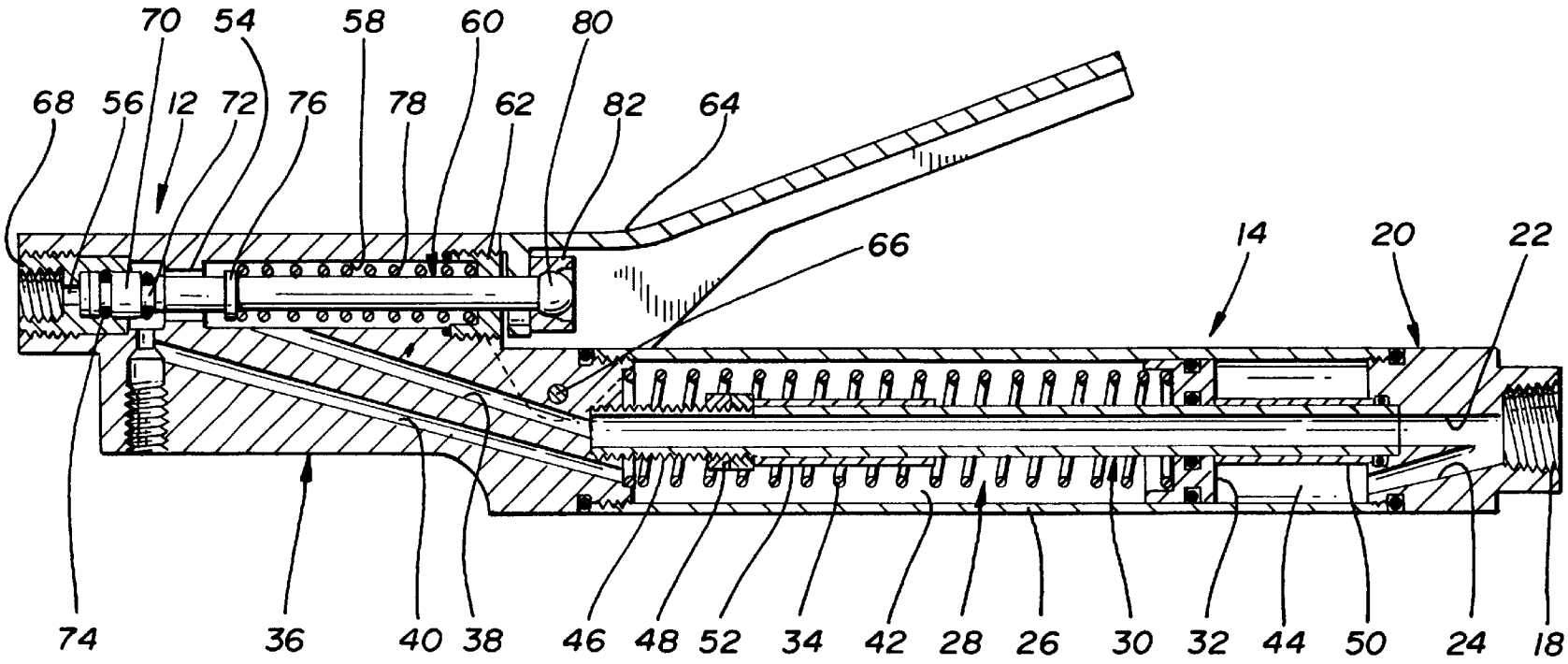
FIG. 2 is a longitudinal, cross-sectional view of the fixed volume power sprayer of FIG. 1, taken along the line A—A of FIG. 1.
Figure 3:
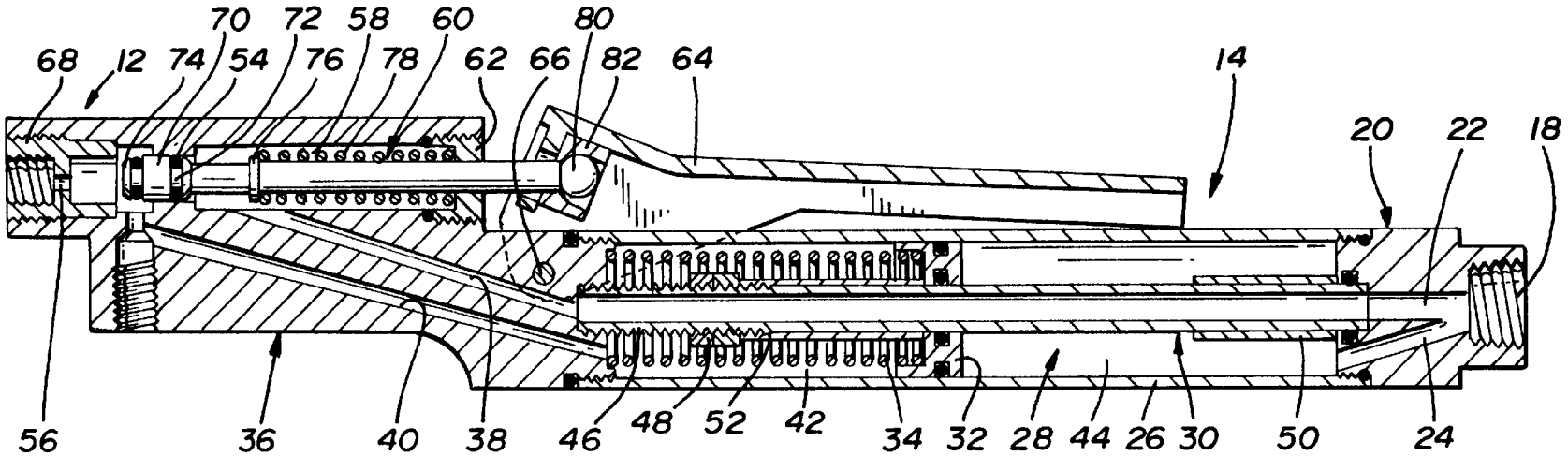
FIG. 3 is a longitudinal, cross-sectional view of the fixed volume power sprayer of FIG. 1, depicted during the spraying mode.

In this preferred embodiment, the pumping means is also integrated with a volume adjusting means, designated generally by the numeral 16 in FIG. 3, by which the volume of an application can be set or readjusted. Such a volume adjusting means 16 includes a threaded interval 46 located on the third main body side of the guide pipe 30, a nut 48 screwed onto the threaded interval 46, and a volume adjuster sleeve 50 which is inserted onto the guide pipe 30 at the opposite end of the threaded interval 46. Thus, as shown in FIGS. 2 and 3, the volume adjuster is found on the opposite side of the piston 32 from the rest of the volume adjusting means. It will be appreciated that any volume adjusting means suitable for the purposes discussed herein may be employed and that the particular features of the volume adjusting means discussed here are for illustrative purposes only and are not necessarily limiting. For example, as an alternative to the volume adjuster sleeve 50 or in compliment therewith, a stopper 52 may be inserted between the nut 48 and the piston 32 in order to adjust the fluid volume by changing the travel distance of said piston 32.

In order to prevent fluid leakage at various points within the sprayer 10, any suitable sealing mechanism known in the art may be used. For example, an ordinary o-ring may be inserted into grooves of the piston 32 and in each connecting area where components meet each other.

The valve means 12 is made to open or close a connection path 54 between third flow path 38 and the fourth flow path 40 of the third main body 36 intermittently, as well as the spray outlet path 56 extending beyond the fourth flow path 40. If the valve means 12 is closed with respect to the connection path 54, the third flow path 38 and the fourth flow path 40 are disconnected and said power sprayer 10 is in a spraying mode due to the opening of the spray outlet path 56 as shown in FIG. 3. If, on the other hand, the valve means 12 is open with respect to the connection path 54, the third flow path 38 and the fourth flow path 40 are connected to each other and the spray outlet path 56 is closed, thereby placing the power sprayer 10 in a filling mode.

The valve means 12 resides in the third main body 36 and includes a generally cylindrical bore 58 formed longitudinally in the upper part of the body 36 and connected to the third and the fourth flow paths 38 and 40. Thus, the bore 58 includes the connection path 54 between the third and fourth flow paths 38 and 40, which in this embodiment has a smaller diameter than the bore 58. A valve such as rod 60 is axially positioned through the bore 58 and through connection path 54 and has at least one portion which is smaller in diameter than the connection path 54. A valve support body 62 seals the bore 58 at the back part of the third main body 36 and maintains the axial alignment of and otherwise supports the valve rod 60. A hinged handle 64, which pivot around a hinge 66, may be manipulated by the user to move the valve rod 60 axially back and forth within the bore 58 such that, as the rod 60 is forced away from the nozzle, considered herein to be the spraying mode, the rod 60 closes the connection path 54 between the third and fourth flow paths 38 and 40 and opens the spray outlet path 56 extending beyond the fourth flow path 40.

A nozzle extension or an applicator (not shown) is typically attached to a nozzle extension fitting 68 shown at one end of the spray outlet path 56 which extends to the bore 58. Thus, it will be appreciated that the bore 58 is divided by the connection path 54, and is connected to the fourth flow path 40 on one side thereof while being connected to the third flow path 38 on the other side thereof.

The valve rod 60 comprises a head 70 which, in the preferred embodiment, includes a rear o-ring portion 72 that is capable of sealing the connection path 54 of one end with the rear o-ring seal. Thus, the head 70 has close to the same diameter as the narrow connection path 54. The head also includes a front o-ring portion 74 that is capable of sealing the spray outlet path 56. Therefore, it will be appreciated that, if the head 70 of valve rod 60 seals the narrow connection path 54, the spray outlet path 56 operatively connected to the fourth flow path 40 will open to allow passage of the flowable material out of the sprayer through the nozzle, the third flow path 38 being disconnected. On the other hand, if the narrow connection path 54 is opened, i.e., if the head 70 of valve rod 60 seals the spray outlet path 56, then the fourth flow path 40 is operatively disconnected from the nozzle and is, instead, connected to the third flow path 54, thereby refilling the first pumping chamber 42.

A holder 76 may reside in the middle of the valve rod 60 to hold one end of a elastic component such as compression spring 78 residing between the valve support body 62 and the holder 76. The compression spring 78 creates a bias or tension which keeps the head 70 of the valve rod 60 sealed against the spray outlet path 56 when the sprayer 10 is not being manipulated by the user.

The end of the valve rod 60 is modified in such a way, as by an enlarged ball 80, that the valve rod 60 can be easily moved in and out of the bore 58 while the hinged handle 64 is manipulated. The enlarged ball 80 is enclosed partially by a valve rod holder 82 attached to the hinged handle 64.

Operation of the aforedescribed embodiment of the power sprayer 10 may be commenced by starting the compressor (not shown). When the compressor starts to run, the highly pressurized, flowable spray material flows through the line hose (not shown) into the first and second flow paths 22, 24 of the first main body 20 of the power sprayer 10.

Initially, as shown in the FIG. 2, the flowable material pumped into the power sprayer 10 by the compressor flows into the first and the second pumping chambers 42, 44. To do so, it will be appreciated that the material to be found in the second pumping chamber 44 enters directly through the second flow path 24. However, material found in the first pumping chamber 42 will first enter the first flow path 22, pass through the guide pipe 30, and then through the third and the fourth flow paths 38 and 40, respectively, before entering the first pumping chamber 42. Because the flowable materials will take the path of least resistance, it will be appreciated that the pressure in both sides of the pumping chambers becomes the same during this filling mode. Once both chambers 42, 44 are filled with the material and since the pressure is the same on both sides of it, the piston 32 is pushed toward the end of the pumping chamber 28 adjacent the first and second flow paths 22, 24 by the biasing tension of the elastic component, e.g., spring 34, until it abuts the end of the volume adjusting sleeve 50. Further movement of the piston 32 is prevented by the volume adjusting sleeve 50. Thus, a fixed volume of material is maintained in the first and the second pumping chambers 42, 44, thereby providing for a fixed volume inflow of the material.

Once the sprayer is filled with material, the user presses the hinged handle 64 against the pumping means 14 such that handle 64 rotates around hinge 66. When the handle is manipulated in such a manner, the valve rod 60 slides or is pulled toward the handle 64 so as to close the third flow path 38 and open the spray outlet path 56 to the nozzle which is operatively connected to the fourth flow path 40 as shown in FIG. 3 and as was described hereinabove. It will be appreciated that, when this occurs, there results a pressure difference between the first pumping chamber 42 and the second pumping chamber 44. This pressure difference creates a driving force which overcomes the elastic or biasing force of the elastic component 34, thereby causing the piston 32 to move toward the third and fourth flow paths 38, 40. The flowable material originally found in the first pumping chamber 42 is forced out of that chamber, passes through the fourth flow path 40 and the spray outlet path 56, and is jettisoned out of the nozzle or like component.

It will be appreciated that the travel distance of the piston 32 is confined by the nut 48 mounted on the threaded interval 46 of the guide pipe 30 or the stopper 52. Thus, only a fixed amount of material is forced out of the sprayer 10 after one cycle, i.e., one completed manipulation of the handle 64. Thus, the amount of material to be sprayed or delivered to a specific site can be predetermined and/or adjusted prior to spraying.

Figure 4:
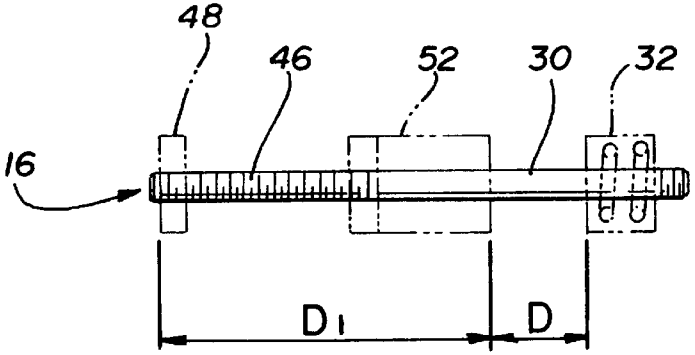
FIG. 4 is a perspective view of the spray volume adjustment mechanism of the fixed volume power sprayer of FIG. 1.

Specifically, the volume of the flowable material sprayed per cycle is determined by the moving distance (D) of the piston 32 until it abuts either the stopper 52 or the nut 48 as shown in FIG. 4. To increase the volume, the nut 48 (and the stopper 52, if used) is simply turned to move toward the end having the threaded interval 46 of the guide pipe 30. To maximize the spray volume per cycle, the nut 48 should be positioned at the far end of the threaded interval 46 adjacent the third and fourth flow paths 38, 40, and the volume adjusting sleeve 50 as well as stopper 52 should be removed, creating a maximum travel distance (D+D1) for the piston 32. Depending upon the size of the sprayer and the intended application, the power sprayer may have a volume of from about 0.1 mL to several liters.

Once the spray is complete, i.e., all of the fixed amount of flowable material is released through the nozzle, the user releases the hinged handle 64 and the hinged handle 64 returns to its initial state due to the biasing force of the return elastic component 78. This action, in turn, slides or otherwise pushes the valve rod 60 away from the handle 64 so as to close the spray outlet path 56 and open the third flow path 38 to the passage of flowable material through the connection path 54 to the fourth flow path 40. That is, the flowable material may again pass through the first flow path 22, through the guide pipe 30, through the third flow path 38, through the bore 58 and specifically the connection path 54, through the fourth flow path 40 and into the first pumping chamber 42. At this point, the fluid pressure of the first and the second pumping chambers 42, 44 will again become equalized, and the piston 32 will again move toward the end of the pumping chamber 28 adjacent the first and second flow paths 22, 24 due to the biasing tension of the elastic component, e.g., spring 34, until it abuts the end of the volume adjusting sleeve 50, thereby completing one cycle.

It will be appreciated that the fixed volume power sprayer 10 described and illustrated herein advantageously has been found to have a short delivery cycle time of from about 0.5 to a few (approximately 2 or 3) seconds per cycle, depending, inter alia, on the size of the sprayer, the maximum capacity of the pumping chamber, and/or the amount of pressure exerted on the flowable material through the hose line and the sprayer. Furthermore, the sprayer appears to have solved the problem of leakage due to internal wear on external parts. Where the flowable materials employed are pesticides, there is a potential harm to the user.

Alternative embodiments of the power sprayer of the type shown in FIGS. 5–16 are also envisioned. Like the preferred embodiment, every other embodiment described herein includes pumping means for forcing a fixed or predetermined volume of flowable material through at least one flow path of the power delivery device by means of line pressure exerted on the flowable material, and valve means, operatively connected to the pumping means, for selectively opening and closing a flow path through which the flowable material moves such that the predetermined volume of flowable material can sprayed out of the power sprayer when the flow path is open and can be redirected to fill the power sprayer when the flow path is closed.

Figure 5:
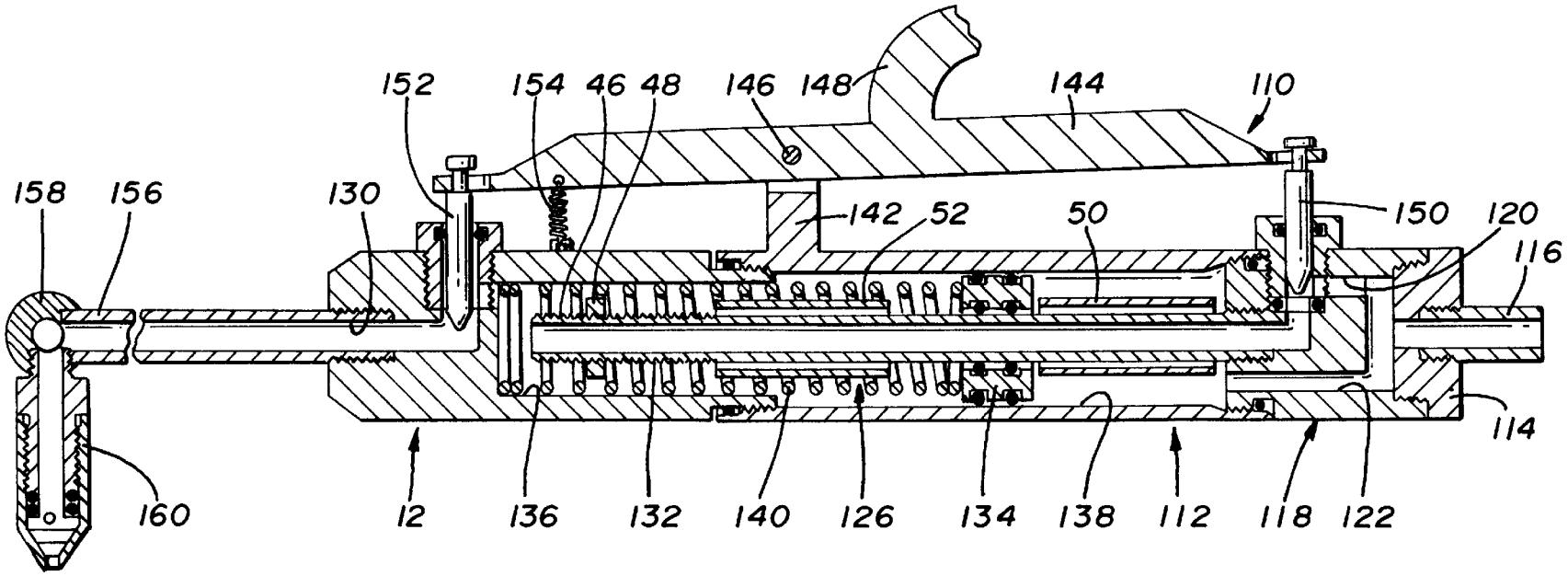
FIG. 5 is a longitudinal, cross-sectional view of an alternative embodiment of a fixed volume power sprayer, depicted during the filling mode.
Figure 6:
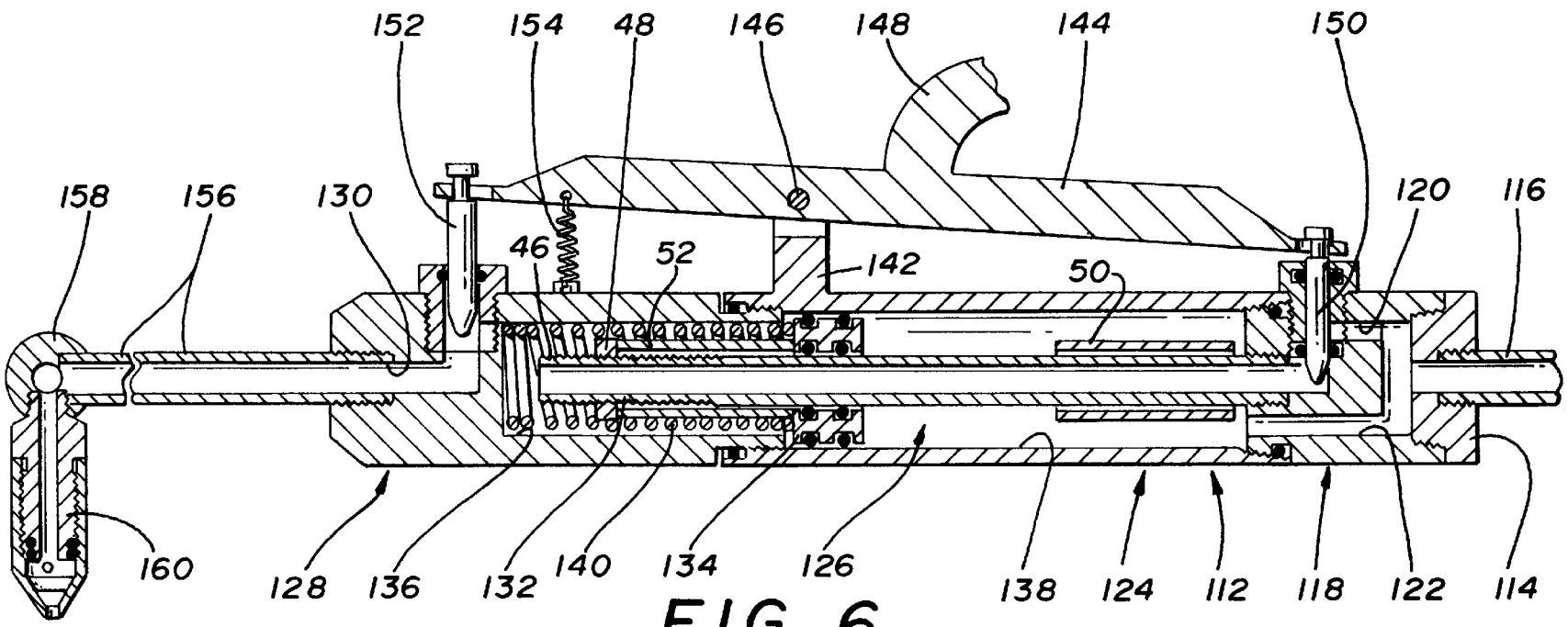
FIG. 6 is a longitudinal, cross-sectional view of the fixed volume power sprayer of FIG. 5, depicted during the spraying mode.

One example of an alternative embodiment of the power sprayer, generally designated by the numeral 110, is shown in FIGS. 5 and 6. This power sprayer 110 provides pumping means, designated generally by the numeral 112, which is essentially the same as is disclosed in the preferred embodiment. That is, the pumping means 112 includes a first main body 114 connected to a high pressure hose line 116 which, in turn, may be connected to a compressor (not shown) or some other pressure-producing device. A second main body 118 sealingly connected to the first main body 114 defines a first flow path 120 and a second flow path 122 which lead to a third main body 124 sealingly connected to the second main body 118 opposite the first main body 114. The third main body 124 defines a pumping chamber 126 and is sealingly connected on its opposite end by a fourth main body 128 which also at least partially defines the pumping chamber 126 and also at least partially defines a third flow path 130. A guide pipe 132 axially extends into the pumping chamber 126 of the third and fourth main bodies 124, 128 and is connected to and operatively extends the first flow path 120 at least partially therethrough. A piston 134 is positioned around and sealingly contacts the outer surface of the guide pipe 132 through a central aperture in the piston 134 and resides in and sealingly contacts the inner surface of the third main body 124.

Like the earlier embodiment, the pumping chamber 126 is divided by the piston 134 into two compartments forming first and second pumping chambers 136 and 138, respectively. Thus, while the first flow path 120 is connected to the inner path of the guide pipe 132, the second flow path 122 is connected to the second pumping chamber 138. The first pumping chamber 136 is connected to the third flow path 124 and provides the area where the guide pipe 132 is terminated to allow flowable material flowing from the guide pipe 132 to spill into the first pumping chamber 136. An elastic or biasing component 140 such as a compression spring is supported at one end by the piston 134 and on the other end by the fourth main body 128.

The pumping means may be integrated with substantially the same fixed volume adjusting means discussed herein with respect to FIG. 4. As the operation of the fixed volume adjusting means is essentially the same for this embodiment, further explanation of this device will not be made, except to say that, by use of such a volume adjusting means 16 having a nut 48 threaded on the interval 46 located on the guide pipe 132, a stopper 52 inserted between the nut 48 and the piston 134, and a volume adjuster sleeve 50 inserted onto the guide pipe 132 at the opposite end of the threaded interval 46, the fixed volume of flowable material can be readily adjusted to the specific operational use.

The most significant change in this alternative embodiment relates to the valve means and its operation in relation to the pumping means. Specifically, the valve means includes a prop 142 mounted on the third main body 124 to which a lever 144 may be hingedly attached as by a hinge 146. A handle 148 (only partially shown) may extend from the lever 144 and provides a convenient means of manipulating the power sprayer 110. At one end of the lever 144 is attached a first valve rod 150 which operably opens and closes the flow path of the flowable material between the first flow path 120 and the guide pipe 132. However, unlike the previous embodiment, at the other end of the lever 144 is attached a second valve rod 152 devised to operatively open and close the third flow path 130 of the fourth main body 128.

Thus, in order to move the piston 134, the first valve rod 150 blocks the flow of material into the guide pipe 132 through the first flow path 120 while the second valve rod 152 moves in an opposite direction and opens the third flow path 124 to expel the flowable material as discussed hereinbelow. Since the flowable material is under pressure and can only travel through the second flow path 122 upon entering the power sprayer 110, the piston 134 is forcibly slid toward the fourth main body 12 (FIG. 6). It will be appreciated then that, when the first valve rod 150 is blocked, the second valve rod 152 is open, and when the first valve rod 150 is open, the second valve rod 152 is blocked.

A biasing component such as spring 154 may be installed near the second valve rod 152 in order to provide that the lever 144, in the case where no pressure is being applied to the lever, maintains the second valve rod 152 closed and the first valve rod 150 open, thereby letting the first flow path 120 be open so that the flowable material may fill both the first and second pumping chambers 136, 138.

Extending from the fourth main body 128 is a nozzle pipe 156 further defining a portion of the third flow path 124, a rotating joint 158 may be connected to the nozzle pipe 156, and a nozzle 160 may be connected to the rotating joint 158.

It will further be appreciated that, for this embodiment, the movement or stroke of the second valve rod 152 is longer than for the first valve rod 150, thereby enabling the first valve rod 150 to be completely closed with respect to the first flow path 120 before the second valve rod 152 is opened and vice versa, thereby further eliminating leaks when the pumping chamber 126 is filled with chemical or when the chemicals are ejected.

In operation then, when the compressor (not shown) or like pressure-inducing means is started, high pressure flowable materials are moved to the first main body 114 through the high pressure hose 116. At this time, the flow of material is open with respect to the first valve rod 150 and closed with respect to the second valve rod 152 due to the mechanic bias of spring 154. Because the flow path with respect to the first valve rod 150 is open, the flowable materials supplied through the high pressure hose 116 flows into the first pumping chamber 136 through the first flow path 120 and guide pipe 132 as well as the second pumping chamber 138 through the second flow path 122. Although there is equal pressure from the flowable materials on both sides of it, the piston 134 is positioned towards the first and second flow paths 120, 122 due to the elastic component supporting or otherwise biasing itself against the opposing side of the piston 134, and is stopped, in this instance, only by the volume adjusting sleeve 50, thereby insuring a constant volume within the first pumping chamber 136 after each cycle, which, in turn, assures the user of providing a constant outflow of materials.

When the user presses the handle 148 or the lever 144 mounted on the hinge 146, the first valve rod 150 moves to close the first flow path 120 and the second valve rod 152 moves to open the third flow path 130. Immediately, the pressure within the second pumping chamber 138, still pressured by the compressor, becomes higher than the pressure in the first pumping chamber 136. Therefore, the piston 134 is forced towards the third flow path 130, overcoming the elastic force of the spring 140, because the first flow path 120 is blocked by the first valve rod 150, and the pressure is applied through the second flow path 122 only. Upon opening the path previously block by the second valve rod 152, it will be appreciated that the flowable materials in the first pumping chamber 136 are forced out through the third flow path 130 and through the nozzle pipe 156 and the nozzle 160.

As with the preferred embodiment, however, the travel distance of the piston 134 is confined by the nut 48 and/or stopper 52 mounted on the guide pipe 132, and this determines the spray quantity of material for one cycle.

Once the emission of flowable material is complete, the user releases the handle 148 and the lever 144 rotates back to its original position due to the elastic biasing characteristic of the spring 154 near the second valve rod 152, thereby returning the second valve rod to a closed position with respect to the third flow path 130 and again moving the first valve rod 150 to open the first flow path 120. Upon reopening of the first flow path 120, high pressure flowable materials will again flow through the first flow path 120 and the guide pipe 132 into the first pumping chamber 136. The piston 134 will also return to its initial state nearer the first and second flow paths, thus completing a cycle.

Figure 7:
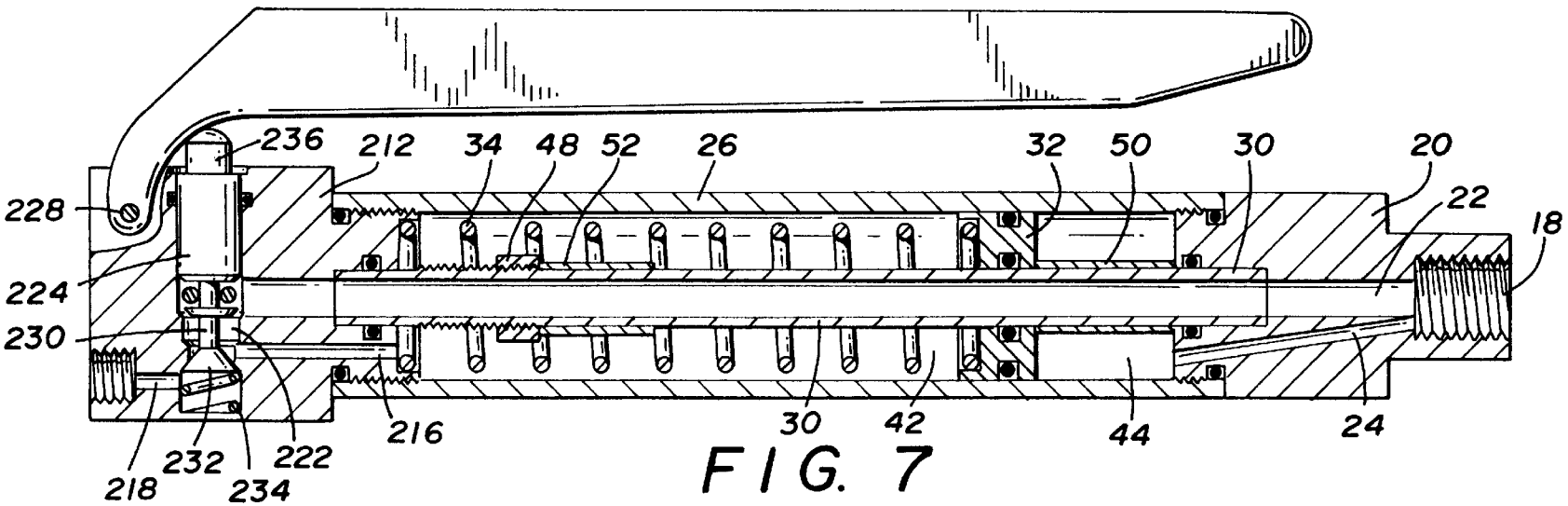
FIG. 7 is a longitudinal, cross-sectional view of another alternative embodiment of a fixed volume power sprayer, depicted during the filling mode.
Figure 8:
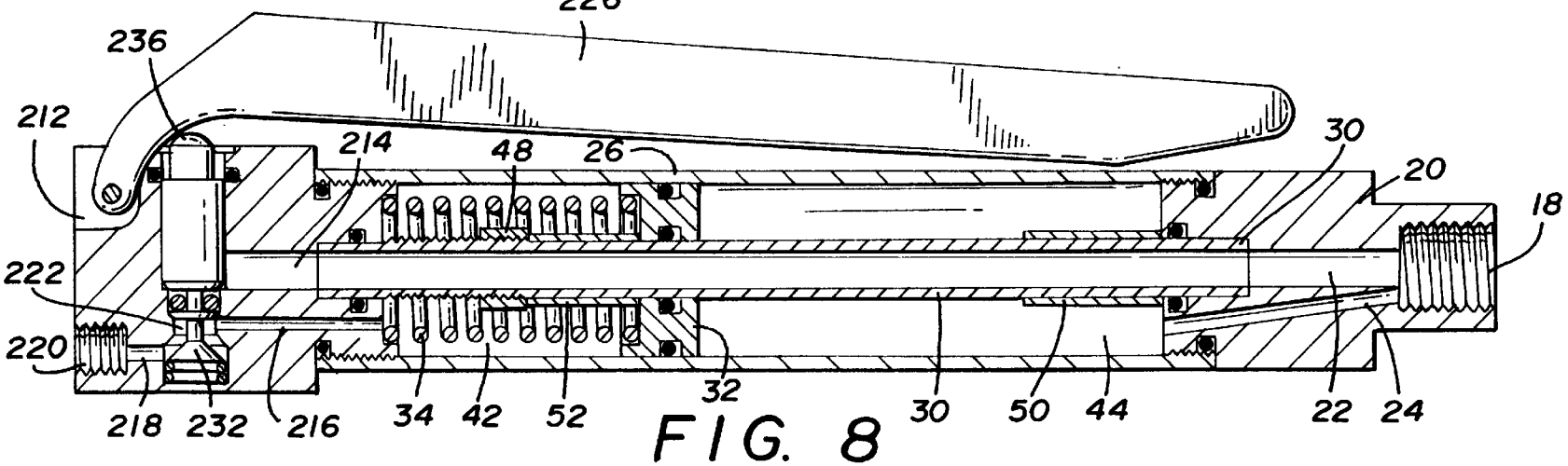
FIG. 8 is a longitudinal, cross-sectional view of the fixed volume power sprayer of FIG. 7, depicted during the spraying mode.

A second alternative embodiment of the present invention is shown in FIGS. 7 and 8. There, a fixed volume power sprayer, designated generally by the numeral 210, includes essentially the same pumping means, designated generally as 212 for this embodiment, as was described in the initial, preferred embodiment. Therefore, where appropriate, those elements which are considered the same will carry the numeral as set forth in the description of the earlier preferred embodiment.

As with the previous embodiment, the most significant change in this alternative embodiment relates to the valve means and its operation in relation to the pumping means. More particularly, the third main body 212 defines a third flow path 214 communicating with the guide pipe 30, a fourth flow path 216 communicating with the first pumping chamber 42, and a fifth flow path 218 communicating with a nozzle fitting 220. Each of these flow paths may communicate with one other as described below through a central flow path 222 also defined by the third main body 212. The third main body 212 also houses a valve rod 224 slidably received within the central flow path 222, and connects a handle 226 to the power sprayer at hinge 228. As shown in FIGS. 7 and 8, the handle may be manipulated to press down the valve rod 224, thereby closing the third flow path 214 to the central flow path 222 and opening the fourth flow path 216 through the central flow path 222 to the fifth flow path 218.

In this embodiment, the valve rod 224 comprises sections of varying diameters to open or close the aforementioned flow paths. When the user presses down on the handle 226, the upper section of the valve rod 224 is pushed downward to block the flow of material through the third flow path 214. However, the middle section 230 of the valve rod 224 is of smaller diameter than the upper section such that, when the handle is pressed, the middle section 230 provides for the opening of the central flow-path 222 to permit the flowable material to move from the first pumping chamber 42, through the fourth flow path 216, to the central flow path 222, on into the fifth flow path 218 and out through the nozzle. When the handle is released, the valve rod 224 is lifted up and return to its original position wherein the lower section 232 of the valve rod 224 closes that part of the central flow path which permits the flow of material from the fourth flow path 216 to the fifth flow path 218. In turn, narrow middle section 230 of the valve rod 224 provides for the reopening of the central flow path 222 between the third flow path 214 and the fourth flow path 216. A biasing component such as spring 234 positioned under the lower section 232 of valve rod 224 provides the lifting force required to return the valve rod 224 to its original position when tile handle 226 is released, thereby completing a cycle.

When the user desires to apply another fixed quantity of material to the specific site, the handle 226 may again be pushed down by hand such that the handle 226 swings down and contacts the head 236 of the valve rod 224 which is pushed into the third main body 212, and the cycle begins again with the valve rod 224 sliding down to close off the third flow path 214 as described hereinabove.

Figure 9:
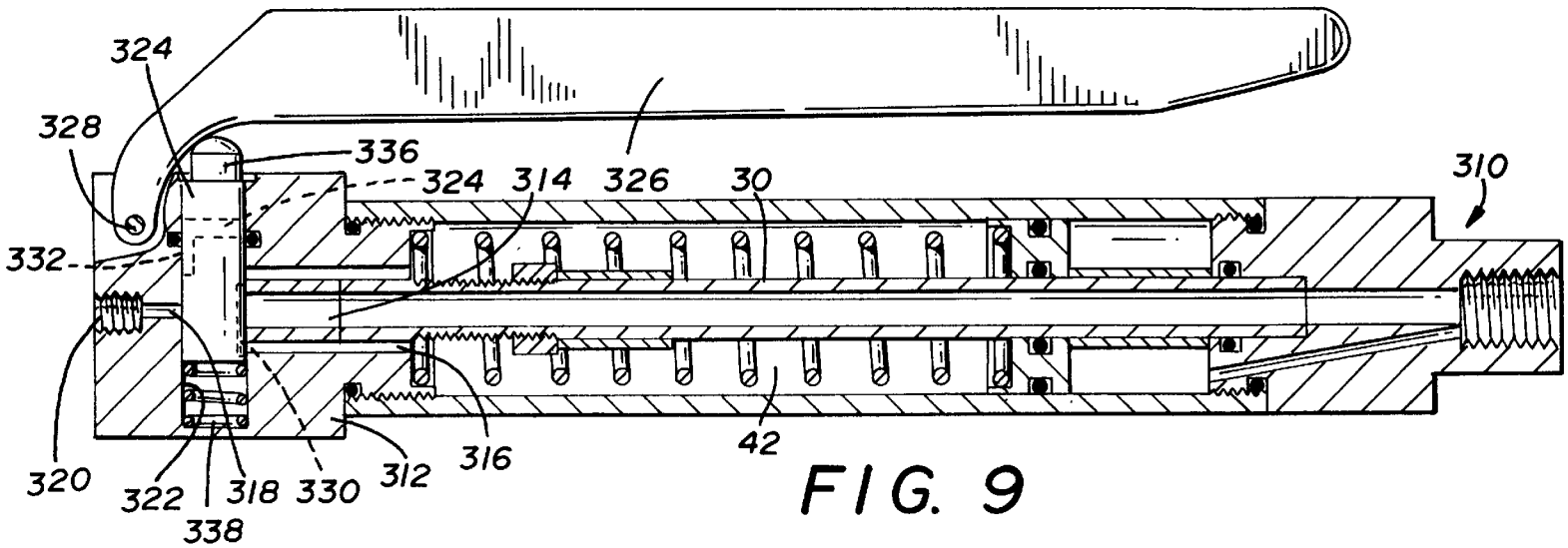
FIG. 9 is a longitudinal, cross-sectional view of yet another alternative embodiment of a fixed volume power sprayer, depicted during the filling mode.
Figure 10:
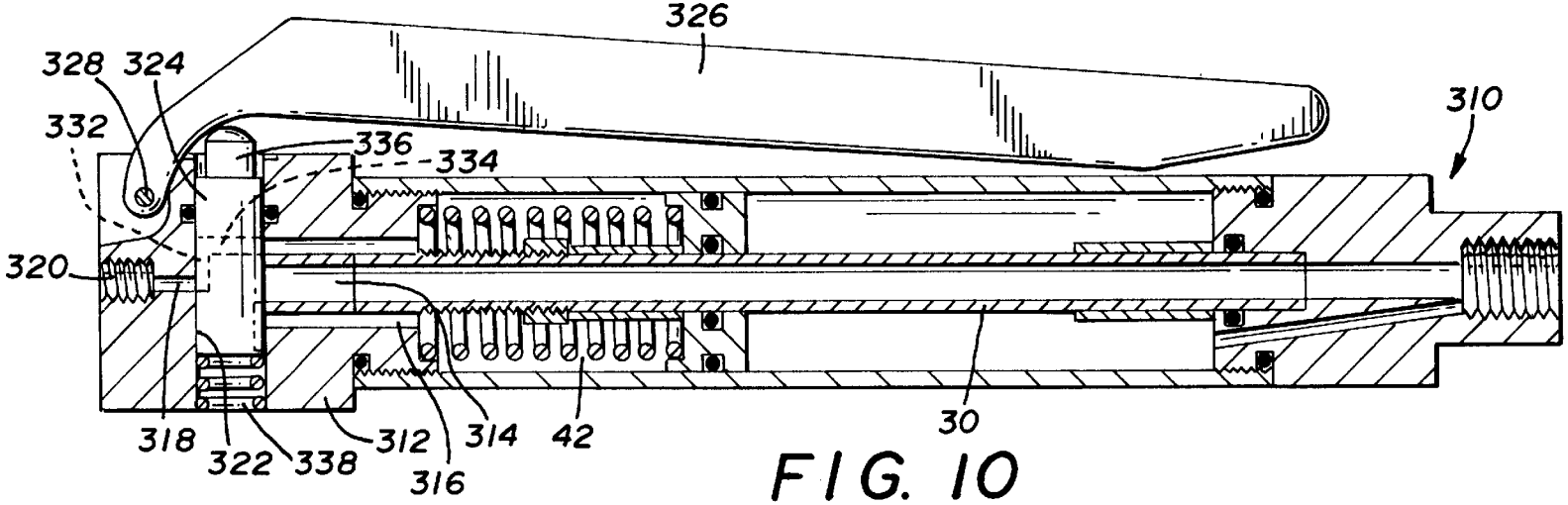
FIG. 10 is a longitudinal, cross-sectional view of the fixed volume power sprayer of FIG. 9, depicted during the spraying mode.

A third alternative embodiment of the present invention is disclosed in FIGS. 9 and 10. This embodiment of the fixed volume power sprayer, designated generally as 310, is very similar to that disclosed in the previous embodiment except that there is an improvement in the valve means and in the third main body as shown in FIGS. 9 and 10.

The third main body 312 has a third flow path 314 communicating with the guide pipe 30 which is axially disposed within the area for a fourth flow path 316 defined by the third main body 312, the fourth flow path 316 communicating with tile first pumping chamber 42. A fifth flow path 318 communicating with a nozzle fitting 320 is also defined within the third main body 312. The third main body 312 also houses a valve rod 324 slidably received within the central bore 322, and connects a handle 326 to the power sprayer at hinge 328.

As can be seen in FIG. 9 wherein the power sprayer 310 is in the resting or filling mode, the valve rod 324 includes two valve grooves 330 and 332. The first valve groove 330 is located on the valve rod surface facing the openings of the third flow path 314 and the fourth flow path 316, while the second valve groove 332 is located on the surface of the valve rod 324 facing the opening of tile fifth flow path 318. To enable the fifth flow path 318 and the second valve groove 332 to communicate with the fourth flow path 316, a cross flow path 334 is provided through the valve rod 324 and operatively connects the opening of the fourth flow path 316 with the second valve groove 332.

When the valve rod is in the position shown in FIG. 9, the third and fourth flow paths 314, 316 will be connected. Thus, it will be appreciated that, ill this position, the flowable material may enter through the third flow path 314, through the first valve groove 330, through the fourth flow path 316 and into the first pumping chamber 42. In addition, it will be appreciated that the cross flow path 334 does not communicate with the fourth flow path 316.

However, when the user desires to spray a fixed volume of flowable material to a specific site, the handle 326 may be pushed down by hand such that the handle 326 swings down and contacts the head 336 of the valve rod 324 which is pushed into the third main body 312, thereby sliding the valve rod 224 downwardly through the central bore 322 and closing off the third flow path 314 from the fourth flow path 316. In turn, the cross flow path 334 opens and communicates with the fourth flow path 316 such that the flowable material is allowed to flow through the fourth flow path 316, through the cross flow path 334, to the second valve groove 332 and fifth flow path 318, where it may then be expelled through a nozzle. Thus, when the fourth and fifth flow paths 316, 318 are connected, the flowable material may be injected out of the power sprayer 310 for spraying.

A spring 338, housed within the central bore 322 below the valve rod 324, acts as the means for providing the lifting force required to return the valve rod 324 to its original position when the handle 326 is released, thereby completing a cycle.

A fourth alternative embodiment of the present invention is shown in FIGS. 11 and 12, and again differs from the previous embodiments substantially with respect to the valve means and third main body portion of the power sprayer, designated in FIGS. 11 and 12 as 410.

The third main body 412 of the fixed volume power sprayer 410 again comprises a third flow path 414 communicating with the guide pipe 30, a fourth flow path 416 communicating with the first pumping chamber 42, and a fifth flow path 418 communicating with a nozzle fitting 420. The third main body 412 also houses a valve rod 424 rotatably received within a central bore 422. This time however, the valve rod 424 includes a valve groove 426 on its surface facing the third and fourth flow paths 414, 416 which operatively connects the third flow path 414 to fourth flow path 416 during the filling mode, and a cross flow path 428 disposed transversely therethrough which connects the fourth flow path 416 to the fifth flow path 418 during the spraying mode. The cross flow path 428 crosses the longitudinal axis of the valve groove 426 and passes through the center of the valve rod 424 perpendicular to the axis thereof but does not pass through the valve groove 426.

Figure 11:
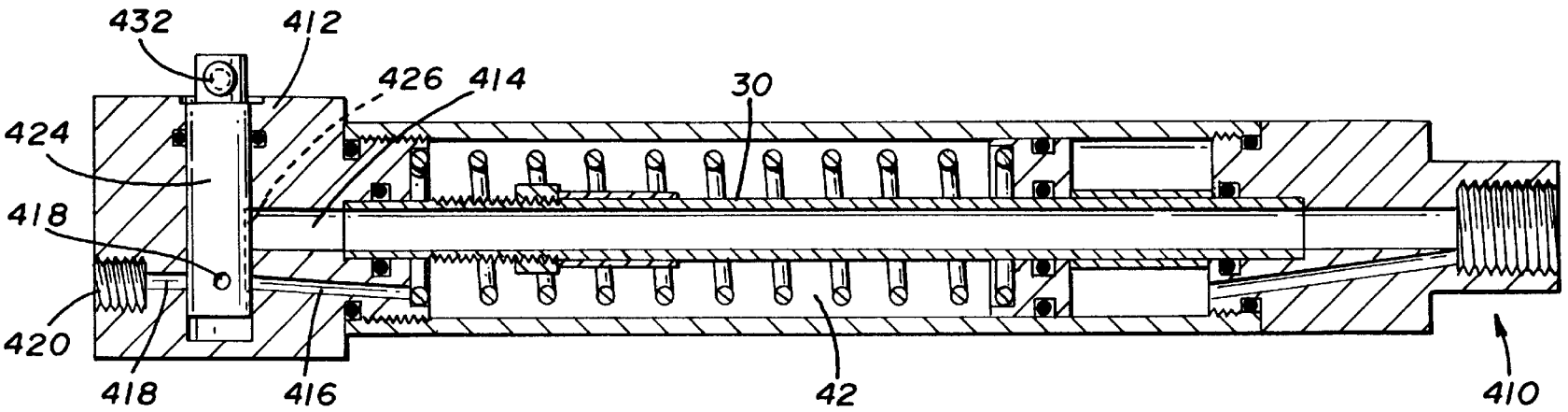
FIG. 11 is a longitudinal, cross-sectional view of still another alternative embodiment of a fixed volume power sprayer, depicted during the filling mode.
Figure 12:
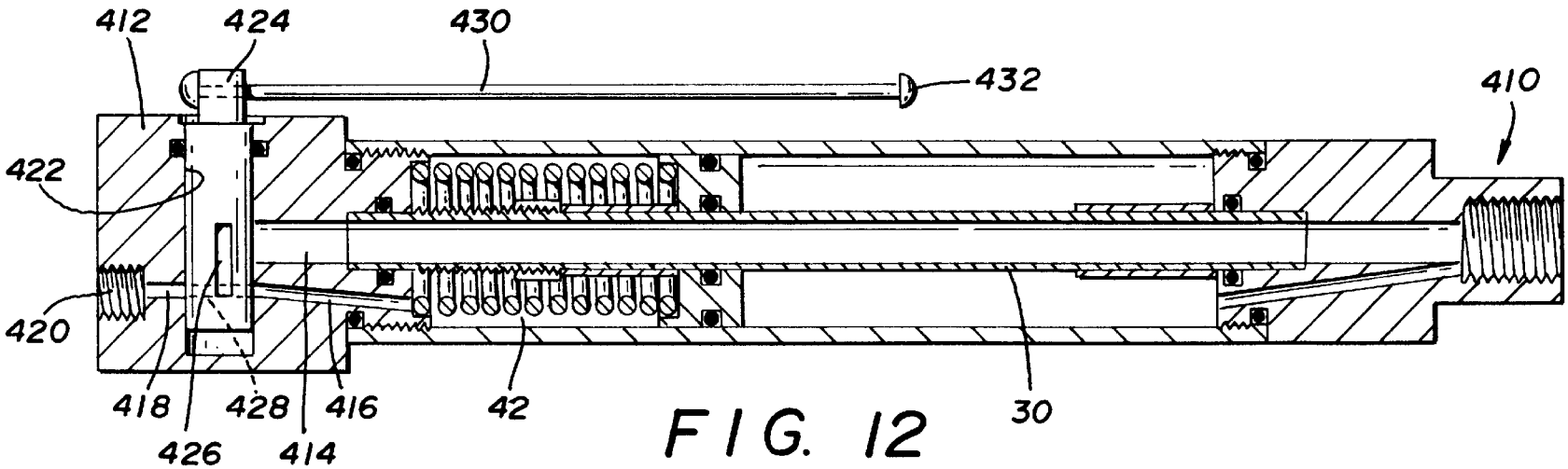
FIG. 12 is a longitudinal, cross-sectional view of the fixed volume power sprayer of FIG. 11, depicted during the spraying mode.

Additionally, the valve rod 424 further includes means, such as hole 432, to receive a rotatable lever 430. Preferably, when the power sprayer is not being used, or is in its filling mode, the lever 430 will be aligned axially with the pumping means of the power sprayer. In this situation, and as shown in FIG. 11, the third and fourth flow paths 414, 416 will be connected. Thus, it will be appreciated that, in this position, the flowable material may enter through the third flow path 414, through the valve groove 426, through the fourth flow path 416 and into the first pumping chamber 42. In addition, it will be appreciated that the cross flow path 428 is turned away and does not communicate with the fourth flow path 416.

However, when the user desires to spray a fixed volume of flowable material to a specific site, the lever 430 may be pushed sideways by hand such that tile lever 430 acts upon the valve rod 424 and rotates the same such that the valve groove 426 no longer communicates with the third flow path 414 or the fourth flow path 416. Instead, the cross flow path 428 is turned so as to communicate with the fourth flow path 416 and the fifth flow path 418, thereby allowing the flowable material to flow through the fourth flow path 416, through the cross flow path 428, to the fifth flow path 418, where it may then be expelled through a nozzle. Thus, when the fourth and fifth flow paths 416,418 are connected, the flowable material may be injected out of the power sprayer 410 for spraying.

It will be appreciated, however, that this embodiment does not include a biasing or torsion spring to return the lever 430 automatically to its initial position. Accordingly, the user must push the lever 430 back into axially alignment with tile power sprayer 410 in order to complete the cycle of returning the valve groove 426 to its state of communication with the third and fourth flow paths 414, 416.

A fifth alternative embodiment is illustrated in FIGS. 13–16, and again provides and improvement to the valve means and third main body portion of the power prayer 510 shown in the drawings. Specifically, a new method to rotate the valve rod, now 524, by pressing the lever 526 is shown. That is, instead of rotating the valve rod as it extends vertically with respect to the lever, this embodiment rotates the valve rod which is in a horizontal or parallel position with respect to the lever.

Like the third alternative embodiment described hereinabove, the third main body 512 has a third flow path 514 communicating with the guide pipe 30 which is axially disposed within the area for a fourth flow path 516 defined by the third main body 512, the fourth flow path 516 communicating with the first pumping chamber 42. A fifth flow path 518 communicating with a nozzle fitting 520 is also defined within the third main body 512. The third main body 512 also houses the aforementioned valve rod 524 which is rotatably received within the central bore 522.

Figure 13:
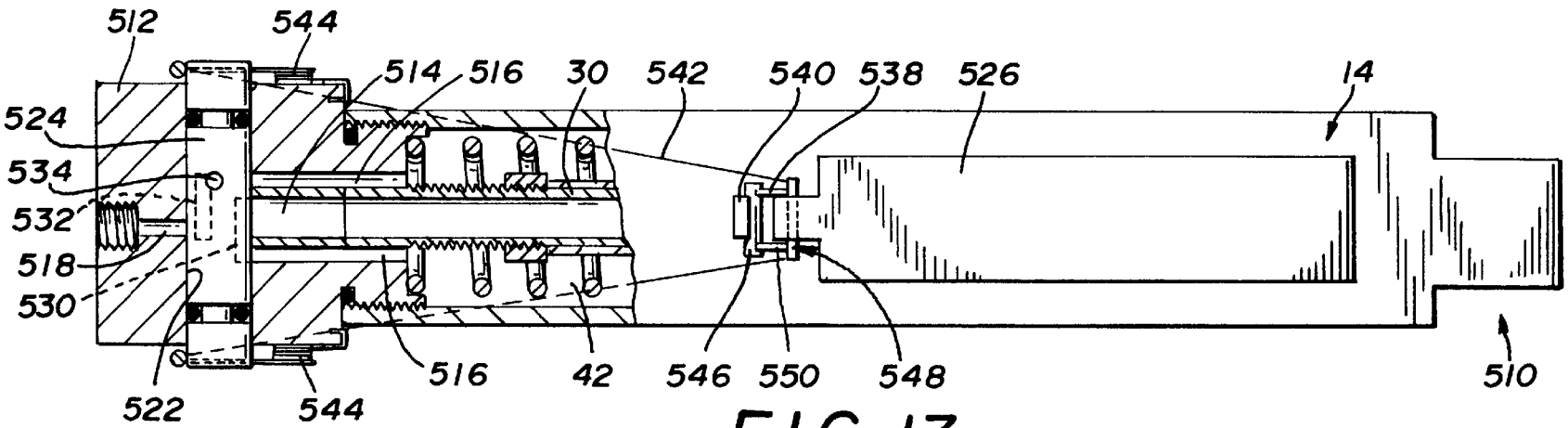
FIG. 13 is a top plan view, partially in cross-section, of still a further alternative embodiment of a fixed volume power sprayer, depicted during the filling mode.

As can be seen in FIG. 13 wherein the power sprayer 510 is in the resting or filling mode, the valve rod 524 includes two valve grooves 530 and 532. At this point, the first valve groove 530 is located on the valve rod surface facing the openings of the third flow path 514 and the fourth flow path 516, and, therefore, providing a means by which the third and fourth flow paths 514, 516 communicate with one another. The second valve groove 532 is also located on the surface of the valve rod 524 essentially perpendicular to the first valve groove 530. Upon rotation of the valve rod 524, the second valve groove 532 will be opened and communicate with the fifth flow path 518. To enable the filth flow path 518 and the second valve groove 532 to communicate with the fourth flow path 516, a cross flow path 534 is provided through the valve rod 524 and operatively connects the opening of the fourth flow path 5 16 with the second valve groove 532 when the valve rod has been rotated.

Any means for rotating the valve rod 524 may be employed without necessarily limiting the scope of the present invention. However, a preferred embodiment of the valve rotating means is shown in FIG. 15 and 16 and includes a lever 526 that can be pressed down toward the pumping means 14, a valve rotating angle regulating means 538 installed at one end of the lever 526 capable of being rotated, a hinge 540 attached to the outer surface of the pumping means 14 and to one end of the valve angle regulating means 538 so that the regulating means 538 can be rotated, at least one cable 542 attached at one end to the end of the valve angle regulating means 538 opposite the hinge 540, and a torsion spring 544 attached to the other end of tile cable(s) 542 and mounted to the third main body 512, and to the valve rod 524 so that the valve rod 524 can be rotated back and forth.

The valve angle regulating means 538 includes a first pin 546 that is rotatably connected to the hinge 540, a second pin 548 operatively attached to tile lever 526 and to the end of the cables 542, and a middle lever 550 which is located between the first and second pins and with which the rotational angle of the valve rod 524 can be adjusted by changing its angle with respect to the pumping means.

Figure 14:
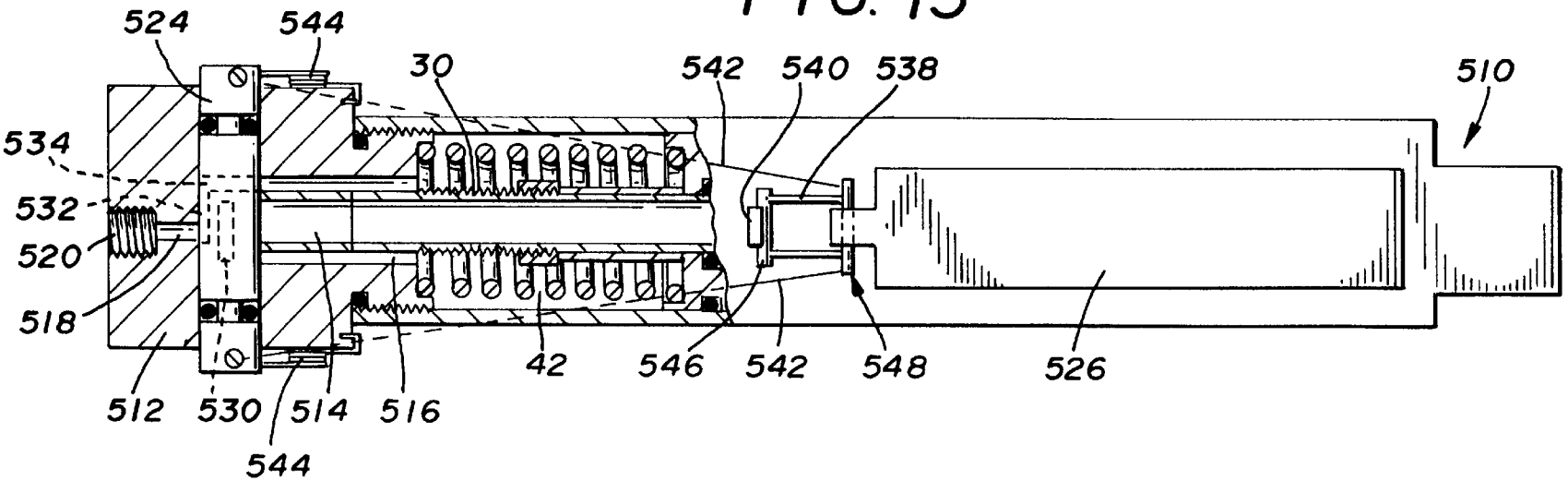
FIG. 14 is a top plan view, partially in cross-section, of the fixed volume power sprayer of FIG. 13, depicted during the spraying mode.
Figure 16:
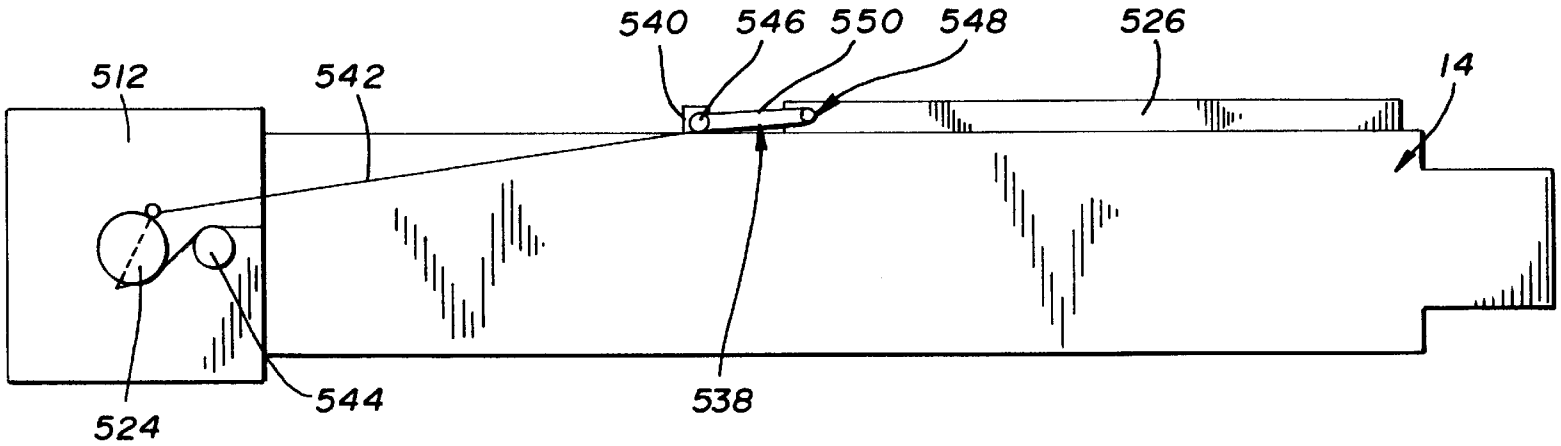
FIG. 16 is a side elevational view of the fixed volume power sprayer of FIG. 14.

Thus, to spray, the user presses the lever 526 as shown in FIGS. 14 and 16. As a consequence, the valve rod 524 rotates due to pulling of one end of the spring 544 by the cables 542 which is pulled by the rotation of valve rotation angle regulaiting means 538. The valve rod 524 rotates and blocks the flow of material from the third flow path 514, and at the same time, turns the cross flow path 534 such that it operatively communicates with the fourth flow path 516 and allows tile flowable material to pass therethrough to the second valve groove 532, to the fifth flow path 518 and on to the nozzle by the force exerted on the piston which is pushed by the pressurized fluid coming only through the second flow path as previously discussed.

Figure 15:
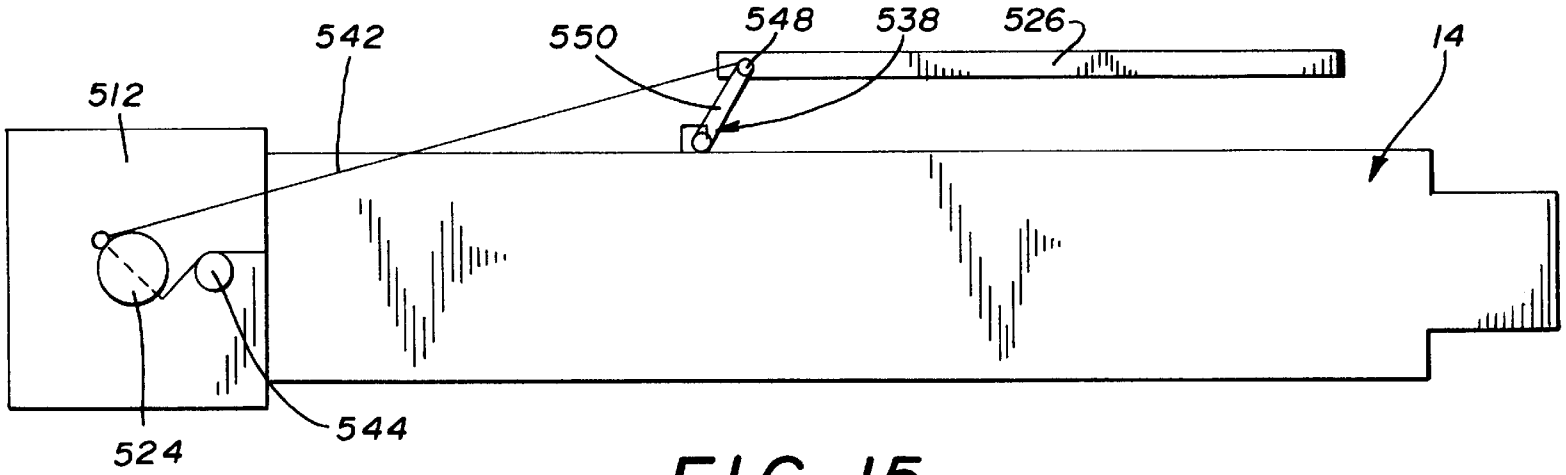
FIG. 15 is a side elevational view of the fixed volume power sprayer of FIG. 13.

To fill the pumping chamber again so that the next spray can be made, the valve rod 524 is rotated back to its initial position as shown in FIGS. 13 and 15, and the sprayer is now in the filling mode as described before.

Thus, it should be evident that the device of the present invention has many advantages over sprayers of the prior art and is highly effective in providing a fixed volume power sprayer which is light weight, easy to operate, and simple in design. The sprayer also provides a unique fixed volume delivery system which is not only simple to use, but also effective in reducing the costs of crop production, in that it reduces the use of labor, time, effort and the amount of spray material actually used without reducing the efficacy of the material employed, thereby lowering the amounts of residues of pesticides and other chemicals left on crops and surrounding environments which, in turn, might have harmful effects on human beings, animals and non-target plants.

The invention is particularly suited for the fixed volume delivery and/or spraying of agricultural chemicals such as liquid fertilizers and pesticides, but is not necessarily limited to this specific area of application. The device of the present invention can be used separately with other equipment, methods and the like, and is open to any other applications that require a delivery or application of a fixed volume of a compressible but flowable materials such as gases, liquids, semi liquids, pastes and/or suspensions.

Based upon the foregoing disclosure, it should now be apparent that the use of the power sprayer 10 described herein will carry out the objects set forth hereinabove. It is, therefore, to be understood that any variations evident fall within the scope of the claimed invention and thus, the selection of specific component elements can be determined without departing from the spirit of the invention herein disclosed and described. In particular, the valve means according to the concepts of the present invention are not necessarily to be limited to those disclosed in the various embodiments described and illustrated herein, but may include essentially any suitable, valve system suitable for the objects and purposes of the invention as disclosed hereinabove. Similarly, the fixed volume adjusting devices disclosed herein should not necessarily be seen as limiting, it being understood that several modifications such devices may be made without departing from the scope of the invention. Further, the elastic components according to the present invention are not necessarily to be limited to springs, but may also include other elastic materials and devices. Moreover, other means for generating pressure can be substituted for the use of a compressor and a hose line. In fact, the invention as described and illustrated is believed to admit of many modifications within the ability of persons skilled in the art. Thus, the scope of the invention shall include all modifications and variations that may fall within the scope of the attached claims.

What is claimed is:

1. A power delivery device for delivering a fixed volume of flowable material to a specific site, the power delivery device comprising:

a pump assembly including a main body defining a pumping chamber and a piston slidably received within said pumping chamber, said pumping chamber being divided by said piston into a first compartment for metering the fixed volume of flowable material and a second compartment;

an inlet for delivering pressurized flowable material to said first compartment and said second compartment of said pumping chamber;

a valve assembly operatively communicating with said pump assembly; and an outlet for releasing the fixed volume of flowable material to the specific site, said valve assembly selectively opening and closing said outlet such that the pressurized flowable material passes from said inlet to fill said first compartment of said pumping chamber when said outlet is closed and the fixed volume of flowable material in said first compartment can be released through said outlet when said outlet is open, and said piston forcing the fixed volume of flowable material through said valve assembly by means of pressure exerted on said piston by said pressurized flowable material.

2. The power delivery device as set forth in claim 1, wherein a first flow path connects said inlet to said second compartment and a second flow path connects said valve assembly to said first compartment.

3. The power delivery device as set forth in claim 2, wherein a third flow path connects said inlet to said valve assembly, thereby providing for direct communication between said inlet and said first compartment.

4. The power delivery device as set forth in claim 3, wherein said third flow path includes a piston guide pipe disposed axially through said pumping chamber, said piston being slidably received around aid piston guide pipe.

5. The power delivery device as set forth in claim 4, wherein a fourth flow path connects said inlet to said piston guide pipe.

6. The power delivery device as set forth in claim 3, wherein a fourth flow path operatively connects said valve assembly to said outlet.

7. The power delivery device as set forth in claim 2, wherein said valve assembly includes a lever hingedly connected to said pump assembly and having a first valve rod attached at one end of said lever devised to operatively open and close a first flow path between said inlet and said first compartment, and a second valve rod attached to an opposite end of said lever devised to operatively open and close, opposite said first valve rod, a second flow path between said first compartment and said outlet, with the proviso that said first valve rod must close said first flow path before said second valve rod opens said second flow path and that said second valve rod must close said second flow path before said first valve rod opens said first flow path.

8. The power delivery device as set forth in claim 7, further including a biasing component installed near said second valve rod to maintain said first valve rod open and said second valve rod closed when no pressure is applied to said lever.

9. The power delivery device as set forth in claim 1, wherein said first compartment includes an elastic component for retaining said piston in a predetermined position when said first compartment is being filled with said pressurized flowable material.

10. The power delivery device as set forth in claim 1, wherein said pump assembly further includes a fixed volume adjusting guide operatively communicating with said pumping chamber and limiting the volume of flowable material that may be released from the power delivery device per cycle when said outlet is open.

11. The power delivery device as set forth in claim 10, wherein said fixed volume adjusting guide operatively communicates with said second compartment.

12. The power delivery device as set forth in claim 10, wherein said fixed volume adjusting guide operatively communicates with said first compartment.

13. The power delivery device as set forth in claim 1, further comprising a piston guide axially positioned within said pumping chamber, said piston being slidably received around said piston guide.

14. The power delivery device as set forth in claim 13, wherein said piston guide is a pipe for receiving said pressurized flowable material therethrough, said pipe being operatively connected to said inlet at one end and to a first flow path operatively communicating with said valve assembly and said first compartment at an opposite end so as to allow said pressurized flowable material to flow directly from said inlet to said first compartment.

15. The power delivery device as set forth in claim 1, further comprising a first flow path operatively communicating between said valve assembly and said first compartment and a second flow path operatively communicating between said valve assembly and said inlet, said valve assembly including a rod having a larger, first diameter and a smaller, second diameter, and being positioned axially within a bore having at least one diameter between said first flow path and said second flow path which bore diameter is larger than said second diameter of said rod and smaller than or complementary to said first diameter of said rod so as to permit said pressurized flowable material to flow from said second flow path to said first flow path when said second diameter of said rod is operatively received within said diameter of said bore, and to prevent the flow of said pressurized flowable material from said second flow path to said first flow path when said first diameter of said rod engages said diameter of said bore.

16. The power delivery device as set forth in claim 15, wherein said rod further includes a third diameter larger than or complementary to a second diameter of said bore located between said first flow path and said outlet, such that once said first diameter of said rod engages said diameter of said bore, thereby closing the flow of said pressurized flow material to said first compartment, the fixed volume of flowable material maintained in said first compartment of said pump assembly is released through said first flow path and said outlet, and once said third diameter of said rod engages said second diameter of said bore, thereby closing the flow of said fixed volume of flowable material to said outlet, said second diameter of said rod is operatively received within said diameter of said bore to permit again the flow of said pressurized flowable material to said first compartment.

17. The power delivery device as set forth in claim 16, wherein said rod includes a head with two regions of O-ring seals which prevents passage of said pressurized flowable material around said head when said first diameter of said rod is engaged with said diameter of said bore and when said third diameter of said rod is engaged with said second diameter of said bore.

18. The power delivery device as set forth in claim 16, wherein said rod is supported at one end by a support body and a holder located proximate said second diameter of said rod, and wherein said valve assembly further includes a return elastic component positioned between said support body and said holder around said rod within said bore.

* * * * *